US006386964B1

(12) United States Patent
Thomas

(10) Patent No.: US 6,386,964 B1
(45) Date of Patent: May 14, 2002

(54) COIN DISPENSING APPARATUS

(75) Inventor: Kim Thomas, Frimley (GB)

(73) Assignee: Mars Incorporated, McLean, VA (US)

( * ) Notice: Subject to any disclaimer, the term of this patent is extended or adjusted under 35 U.S.C. 154(b) by 0 days.

(21) Appl. No.: 09/558,622

(22) Filed: Apr. 26, 2000

(30) Foreign Application Priority Data

Apr. 27, 1999 (GB) ..... 9909676

(51) Int. Cl.[7] ..... G07D 9/00
(52) U.S. Cl. ..... 453/17
(58) Field of Search ..... 453/16, 17; 194/217

(56) References Cited

U.S. PATENT DOCUMENTS 4,883,158 A 11/1989 Kobayashi et al. ..... 453/17 X
5,067,928 A * 11/1991 Harris ..... 453/17
5,531,640 A 7/1996 Inoue ..... 453/17
5,810,654 A * 9/1998 Suzuki et al. ..... 453/17
6,066,038 A * 5/2000 Sciortino et al. ..... 453/17

FOREIGN PATENT DOCUMENTS

EP 0 513 386 A1 11/1992
JP 4-257992 * 9/1992 ..... 453/17

* cited by examiner

*Primary Examiner*—James R. Bidwell
(74) *Attorney, Agent, or Firm*—Fish & Richardson P.C.

(57) ABSTRACT

A changegiver having: an acceptor for accepting coins for payment; a number of coin stores each for storing coins; a control circuit; a dispense outlet; and a dispenser for dispensing coins from the stores into the dispense outlet, under control of the control circuit, in which, in a single payout operation involving the payout of multiple coins, the control circuit is arranged to pay out a first number of coins, and to pause until the occurrence of a predetermined condition before paying out a second number of coins. The first number may be sufficient to occupy a substantial portion of the payout tray but not to overfill it. The predetermined condition may be the elapsing of a predetermined time, or the entry of a predetermined command.

17 Claims, 4 Drawing Sheets

COIN DISPENSING APPARATUS

FIELD OF THE INVENTION

This invention relates to apparatus for dispensing coins.

BACKGROUND OF THE INVENTION

It is known to provide a coin handling apparatus which receives and validates coins of different denominations, and directs valid coins to respective containers each containing coins of a single denomination. It is also known to dispense coins from these containers as change in an amount corresponding to the difference between the value of inserted coins and the price of a product or service obtained from a machine associated with the coin handling apparatus.

Coins are dispensed into a coin return, or payout, tray. For vending machines, this typically has a small volume, capable of holding only a few coins. since a typical change giving operation will involve only the pay out of a limited number of coins.

Occasionally, however, it may be necessary to pay out a larger number of coins. For example, where the coin handling apparatus contains only coins of a low denomination, it maybe necessary to pay out a large number of coins of low value. Furthermore, during servicing, it is sometimes desirable to cause the apparatus to dispense coins down to a predetermined level (e.g. the float level) for each container, or to dispense all coins in each container.

Under such circumstances, unless considerable care is taken by the user, coins may overflow the payout tray and roll away, or jam in the payout tray.

EP 0513386-A1 discloses a game medal dispenser in which a sensor in the payout port senses if a blockage has occurred, and prevents further payouts until an arcade keeper can take appropriate action to clear the blockage.

SUMMARY OF THE INVENTION

Accordingly, in a coin handling apparatus according to the invention, where multiple coins are to be paid out which would exceed the volume available within the payout tray, the apparatus is arranged to pay out a plurality of coins sufficient to occupy a substantial portion of the payout tray but not to over fill it, and to delay paying out further coins until the occurrence of a predetermined condition (for example, a button press by the user, or the elapse of a predetermined time). The delay may comprise a pause, or a reduction of the payout rate.

Other aspects and preferred embodiments of the invention, with corresponding advantages, will be apparent from the following description and claims.

An example of an apparatus in accordance with the invention will now be described with reference to the accompanying drawings, in which:

DESCRIPTION OF KNOWN VENDING MACHINES

Figure 1:
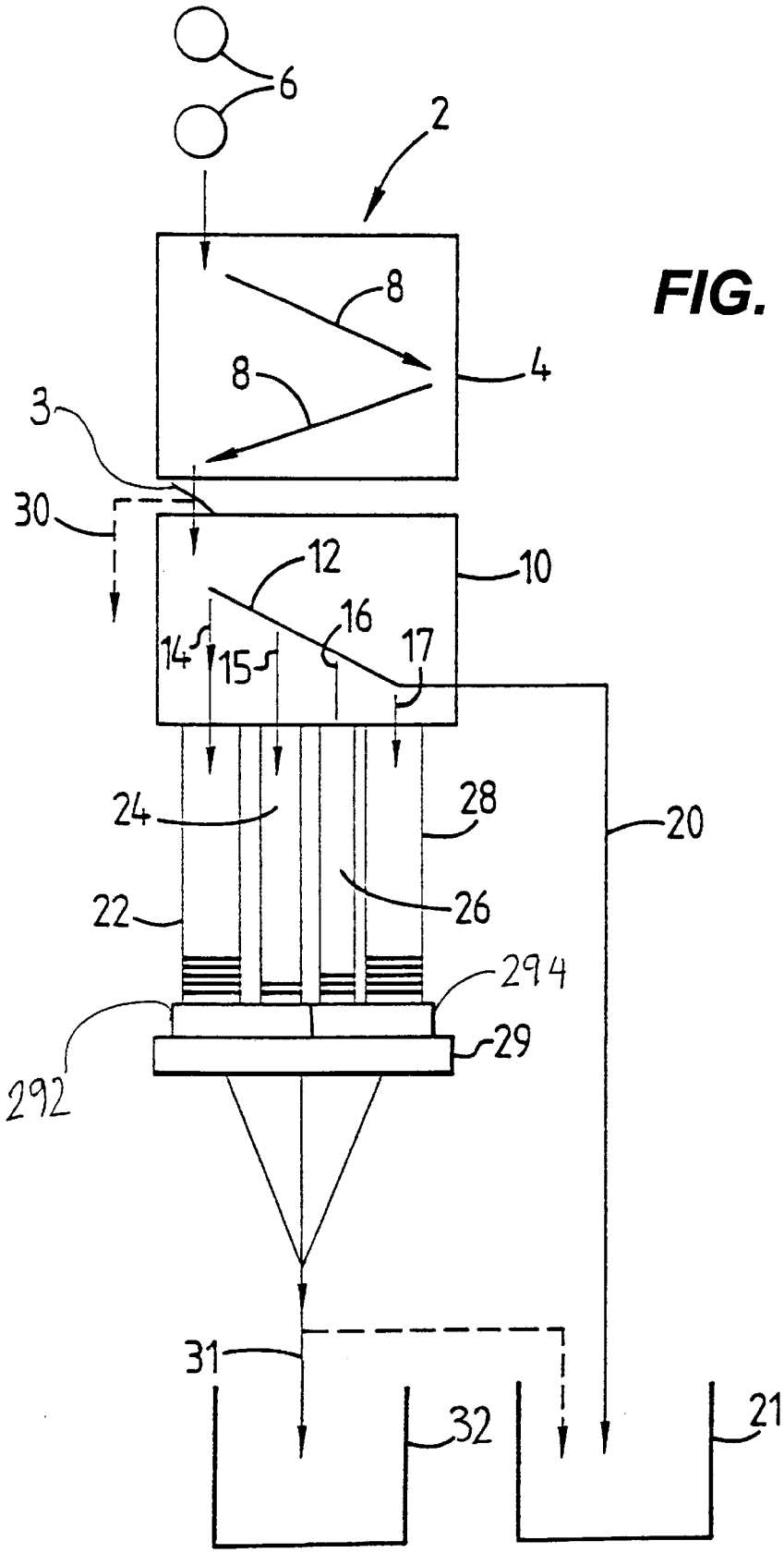
FIG. 1 is a schematic diagram of the mechanical part of a coin handling apparatus.

Referring to FIG. 1, the coin handling apparatus 2 in the vending machine includes a coin validator 4 for receiving coins as indicated at 6. During the passage of the coins 6 along a path 8 in the validator 4, the validator provides signals indicating whether the coins are acceptable. and if so the denomination of the coins. Various types of validators are known, including validators using optical, acoustic and inductive techniques. Examples of such validators are described in, amongst others, GB 1397083, GB 1443934, GB 2254948, GB 2094008 and GB 2288266, the contents of which documents are incorporated herein by reference.

Acceptable coins then enter a coin separator 10, which has a number of gates actuated by respective solenoids controlled by the circuitry of the apparatus for selectively diverting the coins from a main path 12 into any of a number of further paths 14, 15, 16 and 17, or allowing the coins to proceed along the path 12 to a path 20 leading to a cashbox 21. If the coins are unacceptable, instead of entering the separator 10 they are diverted straight to a reject slot via a path 30, by an accept gate 3 driven by an actuating solenoid 203.

Each of the paths 14, 15, 16 and 17 leads to a respective one of four coin tubes or containers 22, 24 and 26 and 28. Each of these containers is arranged to store a vertical stack of coins of a particular denomination. Although only four containers are shown, any number may be provided.

A dispenser indicated schematically at 29 is operable to dispense coins from the containers when change is to be given by the apparatus. The dispensed coins are delivered to a refund path 31 leading to a dispense or payout tray 32, having a volume Z (e.g. on the order of 5 cm×5 cm×2 cm for a vending machine, or 15 cm×15 cm×5 cm for a ticket machine) which may be occupied by coins without jamming of the paths 14–17 or the outlet of the tray, and without the coins falling out.

The dispenser comprises a pair of motors 292, 294 each able to dispense a coin from one of two tubes (22, 24; or 26, 28) beneath which it is located, on energizing of selected windings by the circuitry of the apparatus. It may correspond, for example, to that of our earlier application GB 2274190.

The tubes 22, 24, 26, 28 are provided in a removable cassette, and the tubes themselves are removable from the cassette, as described in GB 2246897, the contents of which are incorporated herein by reference.

DESCRIPTION OF PREFERRED EMBODIMENTS

Figure 2:
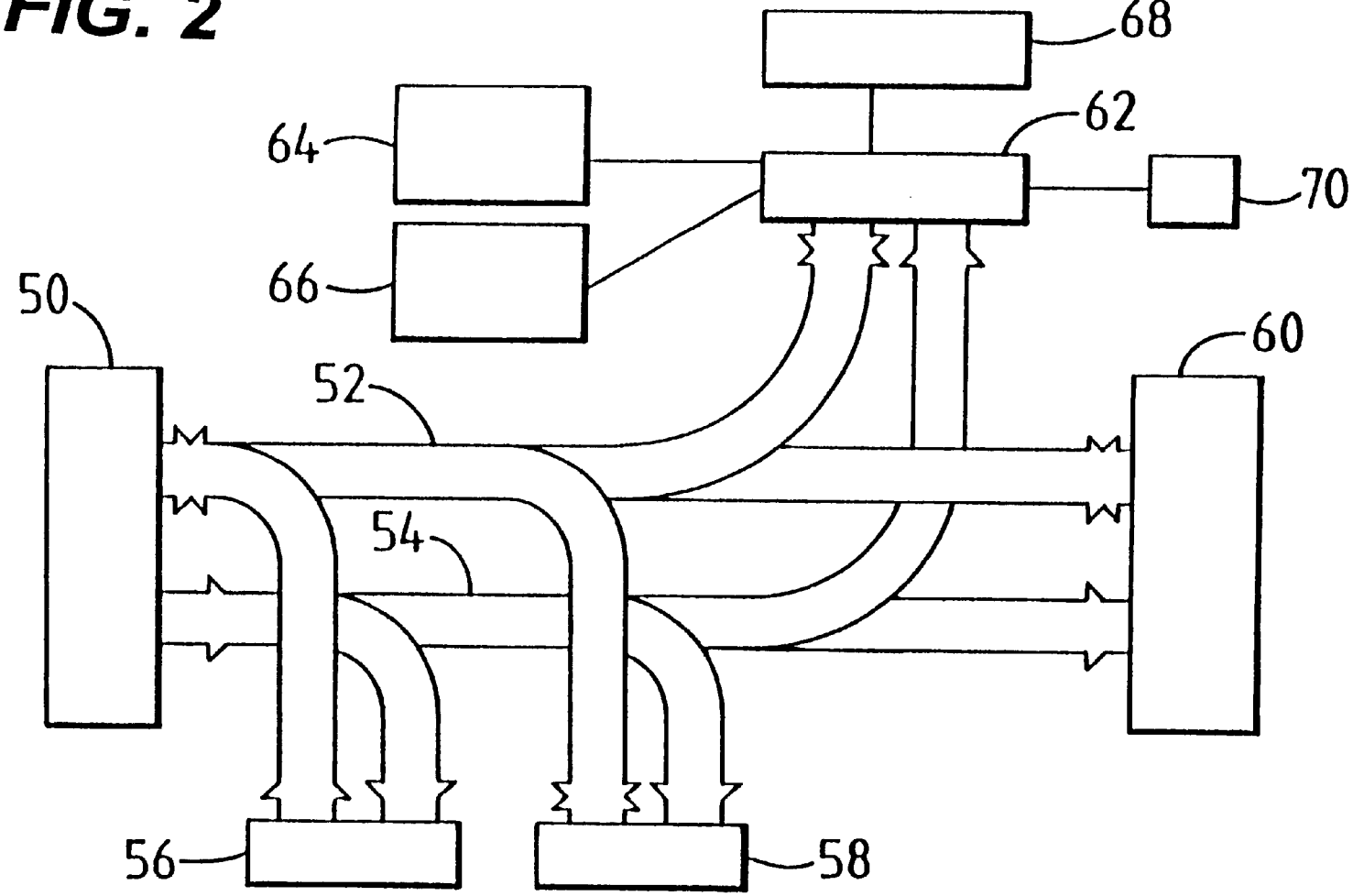
FIG. 2 is a block diagram of the circuit of the coin handling apparatus.

Referring to FIG. 2, the circuit of the present embodiment of the invention incorporates a microprocessor 50 connected to data and address buses 52 and 54. Although separate buses are shown, data and address signals could instead be multiplexed on a single bus. A bus for control signals could also be provided. An LSI could replace the microprocessor.

The microprocessor 50 is connected via the buses 52 and 54 to a read-only memory (ROM) 56 and a random access memory (RAM) 58. The ROM 56 stores the program controlling the overall operation of the microprocessor 50, and the RAM 58 is used by the microprocessor 50 as a scratch-pad memory.

The microprocessor 50, the ROM 56 and the RAM 58 are, in the described implementation, combined on a single integrated circuit.

The microprocessor 50 may also be connected via the buses 52 and 54 to an Electrically Alterable ROM (EAROM) such as a Flash memory, 60, for storing a variety of alterable parameters.

The microprocessor 50 is also coupled via the buses 52 and 54 to input/output circuitry indicated at 62. The circuitry 62 includes circuits for operating the dispenser 29 and the gates of the coin separator 10 and the circuitry of the coin validator 4. The circuitry 62 is connected to a display 68 visible to the operator, and to a keypad 70 accessible only to the operator.

The input/output circuitry 62 also includes an interface 72 between the control circuit of the apparatus and a vending machine circuit board 64 to which it is connected, and a further interface to an audit device 66.

In operation of the apparatus the microprocessor 50 successively tests the signals from the validator to determine whether a coin has been inserted in the apparatus. When a credit has been accumulated, the microprocessor also tests signals from the vending machine to determine whether a vending operation has been carried out. In response to various signals received by the microprocessor 50, various parts of the program stored in the ROM 56 are carried out. The microprocessor is thus arranged to operate and receive signals from the level sensors of the coin containers 22, 24, 26, 28, and to control the accept gate and the gates in the separator 10 in order to deliver the coins to the required locations, and is also operable to cause appropriate information to be shown on the displays 68 of the apparatus and to deliver signals to the vending machine to permit or prevent vending operations typically through vendor price relays. The microprocessor 50 is also operable to control the dispenser to deliver appropriate amounts of change.

The arrangement so far is quite conventional, and the details of particular structures suitable for use as various parts of the mechanism will therefore not be described in detail.

The particular sequence of most of the operations carried out by the microprocessor 50 may be the same as in previous apparatus. A suitable program to be stored in the ROM 56 can therefore be designed by anyone familiar with the art, and accordingly only the operations carried out by the particularly relevant parts of this program will be described.

First Embodiment

Figure 3:
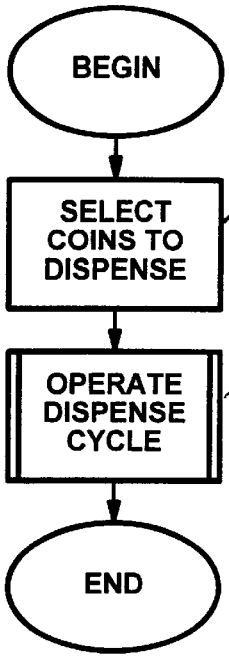
FIG. 3 is a flow diagram showing the overall order of dispensing operations in the apparatus.

On dispensing, as indicated in FIG. 3, at step 102, the coins to be dispensed are selected (for example as disclosed in GB 2284090 or GB 2269258) and in step 104, a dispense cycle operates to dispense the selected coin or coins.

Figure 4:
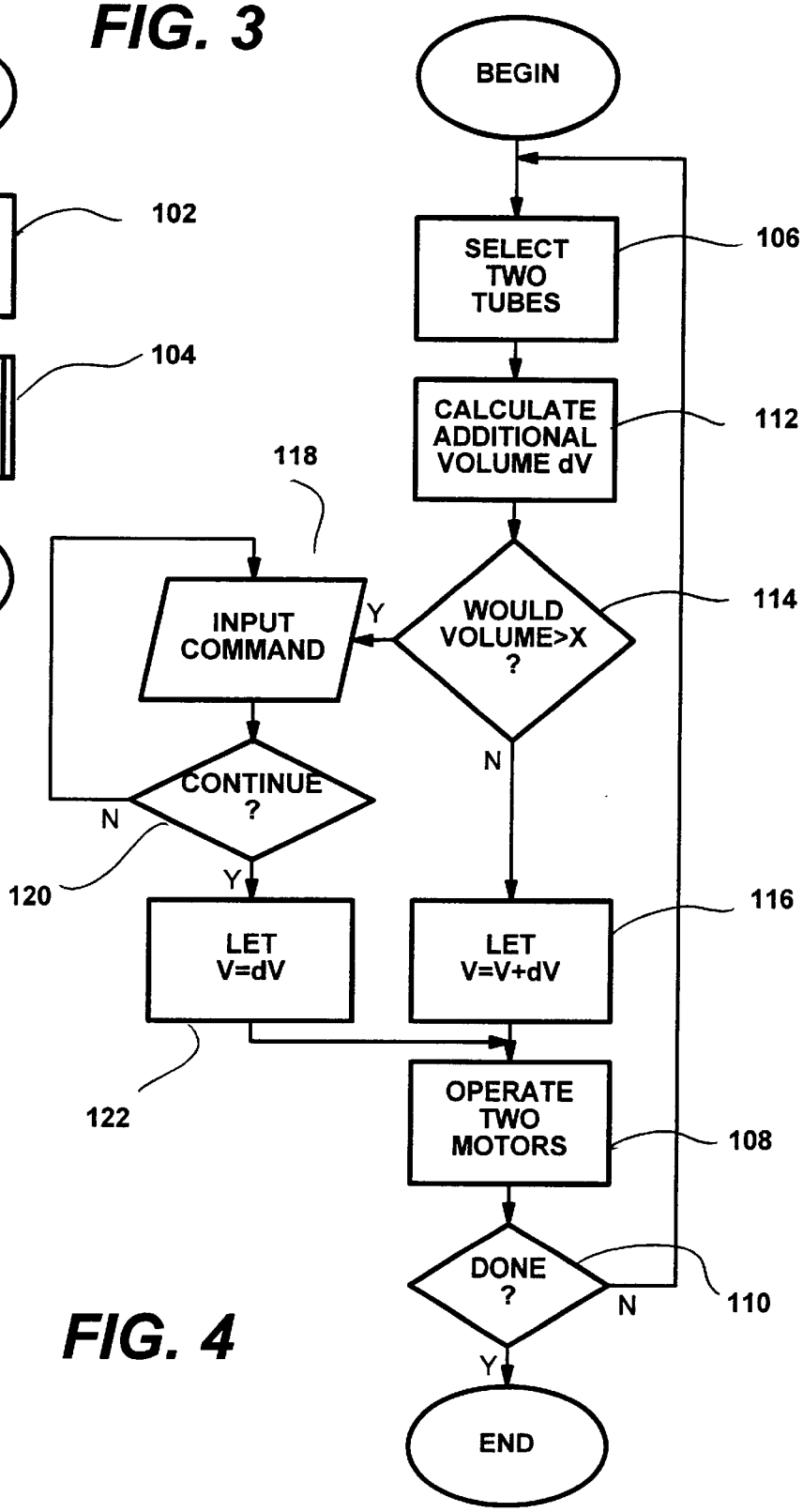
FIG. 4 is a flow diagram showing the dispensing cycle in a first embodiment.

The dispense cycle is shown in FIG. 4. Where the coins to be dispensed are in separate tubes, greater dispensing speed is achieved by simultaneously dispensing from two tubes.

Accordingly, in a step 106, two tubes containing coins selected from those to be dispensed are selected, and in step 108 the two motors 292, 294 are operated simultaneously to dispense a coin from each tube. In step 110, it is determined whether further coins remain to be dispensed and, if so, steps 106 on are repeated.

In a step 112, an increment is calculated, for the two selected coins, to correspond to the additional volume which will be occupied in the payout tray by the two coins. This is performed by reading, from the memory, a constant for the denomination of each coin, and adding the two constants. Each constant is proportional to the volume of a coin of the respective denomination, typically increased by a scaling factor (e.g. 1.1 to 1.5) since the coin will make unusable a larger volume than its own, as the packing of coins is loose.

In a step 114, the sum of the volume increment dV thus calculated and a running volume total V (initially set to zero before any coins are dispensed) is compared with a predetermined volume X corresponding to a predetermined level of substantial filling of the payout tray 32 (for example, 70–80% of its capacity for coins, Z). The level is less than complete filling of the tray, so that if some coins fall edgewise they do not cause a jam or a spill.

If the total is less than X, then (step 116) the running total volume is increased by dV and step 108 is performed to pay out the coins. The 15 processor then returns to step 106 for the next pair of coins (if any). On the other hand, if in step 114 the sum exceeds X, indicating that on payout of the currently selected coins the payout tray 32 would be almost or completely full, in step 118 the processor awaits a predetermined command (for example, a button press on the keypad) in a loop 118–120. A message such as "remove change and press button A" may be displayed on the display.

When the command is entered (step 120), corresponding to the user having emptied the payout tray 32, in step 122 the running total volume V is set to dV, since the only coins in the tray will be those to be dispensed, and the processor proceeds to step 108.

Thus, the above described payout operation can dispense multiple different denominations, having different volumes, simultaneously to achieve a predetermined level in the payout tray 32, without overfilling.

The apparatus is arranged to perform the above-described method both on the occasions where a large volume of change is paid out following acceptance of coins, and on those where a service person opens the vending machine by using a key, and/or by entering a code in keypad 70, and gains access to the apparatus, to cause it to empty its coin tubes.

Second Embodiment

It will be apparent that, where the apparatus contains only one denomination of coin, the above process can be simplified to dispensing a predetermined number of coins, the number being such that the coins substantially fill the payout tray 32 (as discussed above). Naturally, where several denominations are present but coins of each type occupy substantially the same volume, a single number (corresponding to the maximum number of coins, of the largest denomination which will not overfill the tray 32) can be used regardless of coin denomination.

Third Embodiment

Rather than selecting a coin denomination for payout at each operation to enable simultaneous payout of two coins, as disclosed above in the first embodiment, it would be possible to pay out coins from one tube at a time, in turn, in which case a separate predetermined number of coins could be used for each tube.

Fourth Embodiment

This embodiment functions in the same manner as described above in relation to the first, second or third, except that instead of awaiting entry of a command, in steps 118–120 the processor 50 simply displays a message as described above, and then waits for a predetermined time interval (e.g. 20 seconds) before resuming payout at step 122.

Thus, the user is free to use his hands on other tasks.

Fifth Embodiment

In this embodiment, a sensor (not shown) is associated with the tray 32. The sensor could, for example, be a piezoelectric load sensor beneath the tray 32, arranged to respond to the load on the bottom of the tray (and hence the weight of coins therein); or a capacitative sensor responsive to the capacitance of the tray (and hence the number of coins therein); or a motion sensor responsive to the removal of a customer's hand from the tray.

In this embodiment, then, step 118 of FIG. 4 is modified so that the processor 50 awaits the occurrence of a predetermined sensor output signal, indicating that removal of coins has occurred. The signal either corresponds to a reduction in weight, capacitance or other coin-number related property, or to the removal of the operator's hand.

Subsequently, payout is resumed in step 122 as discussed above.

Sixth Embodiment

Figure 5:
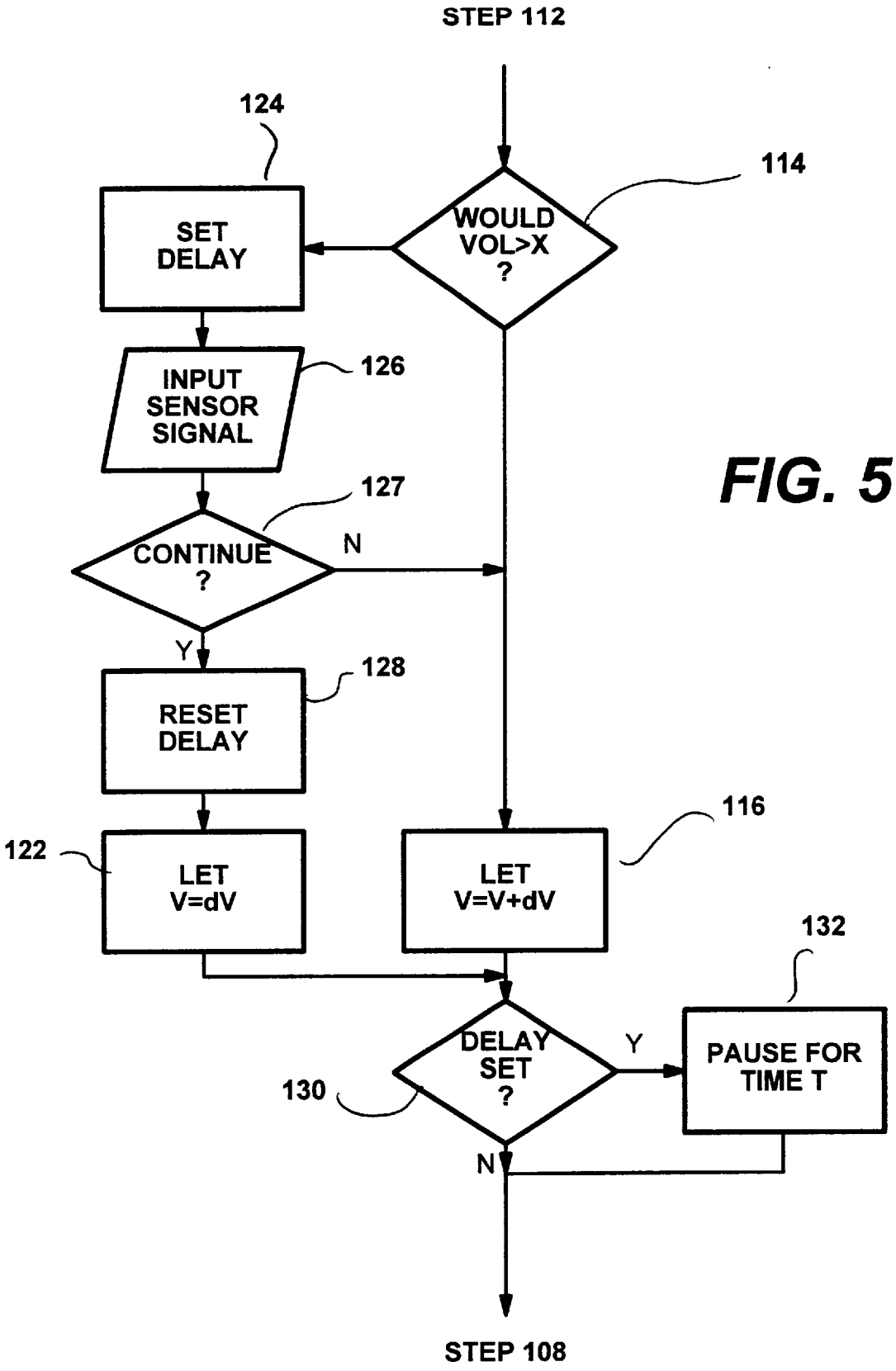
FIG. 5 is a partial flow diagram showing a modification of that of FIG. 4, in a sixth embodiment.

In this embodiment, the process of any preceding embodiment is modified so as to reduce the payout rate of coins into the tray 32, as shown in FIG. 5. Specifically, steps 106 to 116 of FIG. 4 may be performed as described above. If, in step 114, the volume would exceed that safely available in the payout tray 32, in step 124 the processor sets a DELAY flag. In step 126 (similarly to step 118 of FIG. 4) the processor inputs a signal from the sensor associated with the payout tray.

If the signal value indicates (step 127) that coins have been removed, then in step 128 the DELAY flag is reset, and step 122 is performed. If, on the other hand, the signal value indicates that coins have not yet been removed, then step 116 is performed.

After step 122 or step 116 have been performed, in step 130 the processor tests whether the DELAY flag is set. If not (i.e. if the tray is not full), the processor proceeds to step 108, to pay out coins. If it is set, on the other hand, the processor pauses for a time interval T (e.g. two seconds) before proceeding to step 108.

Thus, in this embodiment, when in the "tray full" condition (i.e. more than volume Z is occupied) the payout rate is slowed until the tray is emptied.

Other Variants And Modifications

The invention is not limited to the specific examples described above.

For example, it will be apparent that although coin mechanisms have been described, the invention could be used for mechanisms which accept or dispense tokens in the form of coins, or (with suitable changes to the above details) banknotes. Whereas an active coin separator has been described, it will be apparent that a passive separator could be used.

Rather than counting the number of coins, where a weight-responsive or other coin number-responsive sensor is used, the output of the sensor could be used directly to control the dispensing in any of the preceding embodiments, by paying out while the sensor output was low, then delaying and/or stopping when it is high, until it returns to low when normal payout is resumed. It would even be possible to make the payout rate (i.e. the reciprocal of the interval between subsequent coin dispense operations) a continuous inverse function of the sensor output, so as to lengthen the intervals between coin payouts in monotonic relation to the sensor output.

Whereas a change giver including a coin acceptor is described, it will be apparent that the invention could be used with a cash dispenser lacking any coin acceptor, or a foreign currency money changer arranged to accept coins or bills of one currency and to dispense from separate stores of another currency.

It would be possible to combine the coin payout apparatus described with a banknote acceptor, to accept bills and dispense coins in change. Equally, other forms of payment media (including cashless or electronic media) could be accepted.

Various other modifications will be apparent to the person skilled in the art.

I claim:

1. A coin payout apparatus comprising a plurality of coin stores each for storing a plurality of coins, a control circuit, and a dispenser for dispensing a predetermined quantity of coins from the stores into a payout receptacle, under control of the control circuit, in which the control circuit is arranged to pay out a portion of said quantity of coins sufficient to occupy a substantial portion of the payout receptacle but not to overfill it; to delay paying out further coins until the occurrence of a predetermined condition; and to continue paying out further coins after the occurrence of the predetermined condition.

2. Apparatus according to claim 1, in which the control circuit is arranged, in one mode, to dispense coins from one or more of the stores down to a predetermined level into said, payout receptacle.

3. Apparatus according to claim 2, in which the control circuit enters the mode only when security criteria are met.

4. Apparatus according to claim 1, in which the predetermined condition comprises the elapsing of a predetermined time.

5. Apparatus according to claim 1, in which the predetermined condition comprises the entry of a predetermined command by a user.

6. Apparatus according to claim 1, in which the control circuit is arranged to calculate the number of coins to dispense.

7. Apparatus according to claim 6, in which different said stores contain respective different denominations of coins, and in which said control circuit is arranged to calculate said number of coins by forming a sum of numbers of each denomination of coin to be dispensed, weighted by respective weighting factors related to the relative volumes within said receptacle occupied by a coin of each denomination.

8. Apparatus according to claim 1, further comprising of a sensor associated with the payout receptacle, and in which the predetermined condition comprises an output of said sensor.

9. Apparatus according to claim 8, in which the sensor senses removal of coins.

10. Apparatus according to claim 8, in which the sensor senses a predetermined number of coins.

11. Apparatus according to claim 1, in which the step of delaying paying out comprises increasing the delay between subsequent coin dispenses by a predetermined amount until the occurrence of said condition.

12. A method of dispensing a plurality of coins comprising the steps of:

testing whether further dispensing would overfill a payout receptacle;

if so, reducing the rate of dispensing coins for a period sufficient to allow emptying of the payout receptacle; and then;

if necessary, paying out any remaining coins to be dispensed.

13. A method according to claim 12, including providing a predetermined number of coins related to the number which would overfill a payout receptacle.

14. A method according to claim 13, in which said number is a predetermined constant.

15. A method according to claim 13, further comprising calculating said number.

16. A method according to claim 15, in which there are a plurality of coins of different types to be dispensed, and said step of calculating said number comprises determining a number of each type of coin in accordance with the relative volumes occupied thereby in a payout tray.

17. A changegiver comprising:

means for accepting payment;

a plurality of coin stores each for storing a plurality of coins;

a control circuit;

a dispense outlet; and a dispenser for dispensing coins from the stores into the dispense outlet, under control of the control circuit in which, in a single payout operation involving the payout of a predetermined quantity of coins, the control circuit is arranged to pay out a first plurality of coins, and to delay paying out a second plurality of coins until the occurrence of a predetermined condition.

* * * * *